US005526658A

United States Patent [19]

Cross et al.

[11] Patent Number: 5,526,658

[45] Date of Patent: Jun. 18, 1996

[54] HANDCUFFS

[75] Inventors: Geoffrey W. Cross, Stourbridge; David Wakefield, Birmingham, both of United Kingdom

[73] Assignee: Hiatt and Company Limited, United Kingdom

[21] Appl. No.: 334,937

[22] Filed: Nov. 7, 1994

[30] Foreign Application Priority Data

Nov. 10, 1993 [GB] United Kingdom ..... 9323177

[51] Int. Cl.[6] ..... E05B 75/00

[52] U.S. Cl. ..... 70/16

[58] Field of Search ..... 70/15–17, 14, 70/18, 19; 119/802, 816

[56] References Cited

U.S. PATENT DOCUMENTS

| | | | |
|---|---|---|---|
| 647,735 | 4/1900 | Widmayer | 70/16 |
| 929,910 | 8/1909 | Wood | 70/16 |
| 3,616,665 | 11/1971 | Rosenthal | 70/16 |
| 3,740,977 | 6/1973 | Stefansen et al. | 70/16 |
| 4,300,368 | 11/1981 | Sullivan | 70/16 |
| 4,840,048 | 6/1989 | Elam | 70/16 |
| 5,007,257 | 4/1991 | Thompson | 70/16 |
| 5,205,142 | 4/1993 | Kruger et al. | 70/16 |
| 5,233,848 | 8/1993 | Elam | 70/16 |
| 5,461,890 | 10/1995 | LaFavor | 70/16 |

FOREIGN PATENT DOCUMENTS

| | | | |
|---|---|---|---|
| 2268778 | 1/1994 | United Kingdom | 70/16 |

*Primary Examiner*—Lloyd A. Gall
*Attorney, Agent, or Firm*—Kirschstein et al.

[57] ABSTRACT

A rigid handcuff (FIG. 3) includes a pair of separate lockable bracelet members (16, 18) each having a respective plate-like extension (30, 32) each of which abuts the other at end face along a line normal to a longitudinal axis of the handcuff, the line and the axis lying in the common plane of the bracelet members. A respective plate-like connector (38) overlies the abutted extensions (30, 32) with the outer ends of each connector (38) abutting against a respective bracelet member (16, 18). The extensions (30, 32) and the connectors (38) ensure that the bracelet members are restrained against all movement relative to one another thereby providing a rigid handcuff assembly. A cover assembly comprising a pair of opposed plastic cover members provides a rigid grip for the handcuff intermediate the bracelet members.

8 Claims, 2 Drawing Sheets

HANDCUFFS

BACKGROUND OF THE INVENTION

This invention relates to handcuffs of the type comprising a pair of lockable bracelet members connected together by a rigid body portion.

Rigid handcuffs are well known per se and date back at least to the beginning of the twentieth century. Also known and widely used is a chain type of handcuff wherein two lockable bracelet members are interconnected by a chain and it has been proposed to modify such chain type of handcuff by connecting two opposed plastic cover plates about the chain to abut parts of the bracelet members so as effectively to provide a rigid handcuff. Such a modification is disclosed in U.S. Pat. No. 4,840,048 wherein tyro opposed plastic cover plates are connected about the chain to abut parts of the bracelet members so as to provide a rigid handcuff with the bracelet members co-planar with one another. However, in such a modification the only rigidity imparted to the handcuff is through the medium of the plastic cover plates themselves and their abutment against the bracelet members. The chain itself does not provide any resistance against bending of the cover plates such as may occur if a determined prisoner attempts to deflect the bracelet members, when locked about his wrists, out of their common plane. In such a circumstance one or both of the cover plates may fracture and although the wrists would still be restrained by the chain interconnecting the bracelet members, the;handcuff may be left with jagged edges to the cover plates which may be dangerous to the prisoner or may be used by the prisoner in an offensive manner.

Another type of handcuff which has been extensively utilized is a hinge type wherein the two bracelet members are hingedly connected together about one or more pivot axes parallel to the plane of the bracelet members permitting said members to be pivoted from an extended co-planar orientation to a folded position in which the bracelet members overlie one another.

There is currently a requiremet for rigid handcuffs and one recent proposal therefor is disclosed in GB-A-2 265 414. This proposal discloses a rigid handcuff assembly comprising plate-like body members each having an arcuate part of a lockable bracelet integral therewith at each end of the body member. The body members may be covered by plastics cover plates of the same general type disclosed in U.S. Pat. No. 4,840,048.

It is generally economically mote attractive to provide a rigid handcuff by modifying an existing commercially available design of handcuff rather than to provide an all new design. Thus, in economic terms, it would be more attractive to provide the modified chain type of handcuff as disclosed in U.S. Pat. No. 4,840,048 than to manufacture the handcuff disclose in GB-A-2,265,414 but, as mentioned above, there can be problems in use of the modified chain type of handcuff.

The objects of the present invention are to provide a new and improved construction of rigid handcuff and method for the manufacture thereof.

SUMMARY OF THE INVENTION

In accordance with one broad aspect of the invention there is provided a rigid handcuff comprising a pair of separate lockable bracelet members interconnected together in co-planar spaced apart relationship by rigid connector means restraining said bracelet members against movement relative to one another in their common plane, and a cover assembly comprising a pair of opposed cover members each mountable on a respective side of the handcuff to overlie at least said connector means.

Also in accordance with a broad aspect of the invention there is provided a method of producing a rigid handcuff from a pair of separate lockable bracelet members comprising the steps of interconnecting said bracelet members together in co-planar spaced apart relationship by rigid connector means whereby said bracelet members are restrained against movement relative to one another in their common plane, and securing cover members over said connector means to provide a grip for the handcuff.

In one embodiment of the invention the rigid handcuff may comprise a pair of separate lockable bracelet members having integral projecting plate-like extensions which abut one another at end faces thereof along a line normal to a longitudinal axis of the handcuff, said line and said axis lying in the common plane of the bracelet members, and rigid connector means comprising at least one plate-like connector secured to said extertsions to overlie them and to abut at each of its ends against an abutment surface of a respective bracelet member whereby said bracelet members are restrained against all movement relative to one another.

In such an embodiment the said abutment surface of each bracelet member may comprise an uninterrupted linear or curvilinear surface for abutment by a correspondingly shaped end surface of the plate-like connector.

In a modification of such are embodiment of the invention each bracelet member may be known per se as part of a hinge type of handcuff of the type having a plurality of recesses extending from one side to the other of each bracelet member intended to receive rigid hinge links pivotably mounted in the recesses. Thus the said abutment surface of each bracelet member may comprise a toothed or castellated profile for abutment by a correspondingly profiled end surface of the plate-like connector.

In a further embodiment of the invention the rigid handcuff may comprise a hinge type of handcuff assembly having a pair of lockable bracelet members interconnected by rigid hinge links affording apertures therebetween whereby in the extended condition of said assembly the bracelet members and the hinge links lie in a common plane and said apertures extend from one side to the other of the assembly, and locking members extending into said apertures when the assembly is in its said extended condition whereby said locking members restrain the bracelet members against pivotal movement relative to one another.

The locking members are conveniently provided on a cover assembly for the hinge links comprising a pair of rigid opposed cover members each mountable on a respective side of the handcuff assembly, at least one of said cover members supporting one or more of said locking members whereby the cover assembly provides a rigid grip for the handcuff intermediate the bracelet members. Each said locking member is preferably of such a cross-sectional configuration as to fit tightly within a respective said aperture thereby to restrain the bracelet members against pivotal movement relative to one another.

Conveniently the locking members are integral with a respective said cover member. Each said cover member may include a plurality of locking members of such a length as to extend at least partially into respective said apertures. The locking members provided on each cover member may be of the same length whereby when said cover members are assembled one on each side of the handcuff assembly, respective locking members of the two cover members abut one another at their respective ends, said ends being located on or substantially on said common plane of the handcuff assembly which contains the bracelet members and hinge links. Alternatively, respective pairs of opposed locking members on the cover members may be configured to interengage one another with a wedging or interlocking action.

Each cover member may be formed of a plastic material with integral said locking members. Each cover member of the cover assembly may be of identical configuration whereby, to modify an existing hinge type of handcuff assembly to a rigid handcuff in accordance with the invention, it is only necessary to produce a single plastic molding whereby said modification may be effected in an extremely economical manner. The cover members may be secured to one another and to the handcuff assembly by nut and bolt means, the bolts extending through respective parts of the cover members and the bracelet members, or alternatively or additionally the cover members may be assembled to and secured on the handcuff assembly by means of an interlocking interengagement between opposed locking members of the cover members. The assembly of the cover members to the handcuff assembly may be further enhanced by providing an adhesive between respective outer surfaces of the handcuff assembly and inner surfaces of the cover members.

In all of the embodiments of the invention each cover member is preferably of generally plate-like form having an inner face in contact with a respective one side of the handcuff assembly and an outer face which may be contoured to afford a good gripping surface for the user. Each said cover member is preferably of sufficient length to overlie at least part of respective coplanar outer surfaces of the bracelet members as well as to overlie the said connector means interconnecting the bracelet members.

BRIEF DESCRIPTION OF THE DRAWINGS.

Other features of the invention will become apparent from the following description given herein solely by way of example with reference to the accompanying drawings wherein:-

DESCRIPTION OF THE PREFERRED EMBODIMENTS

Figure 1:
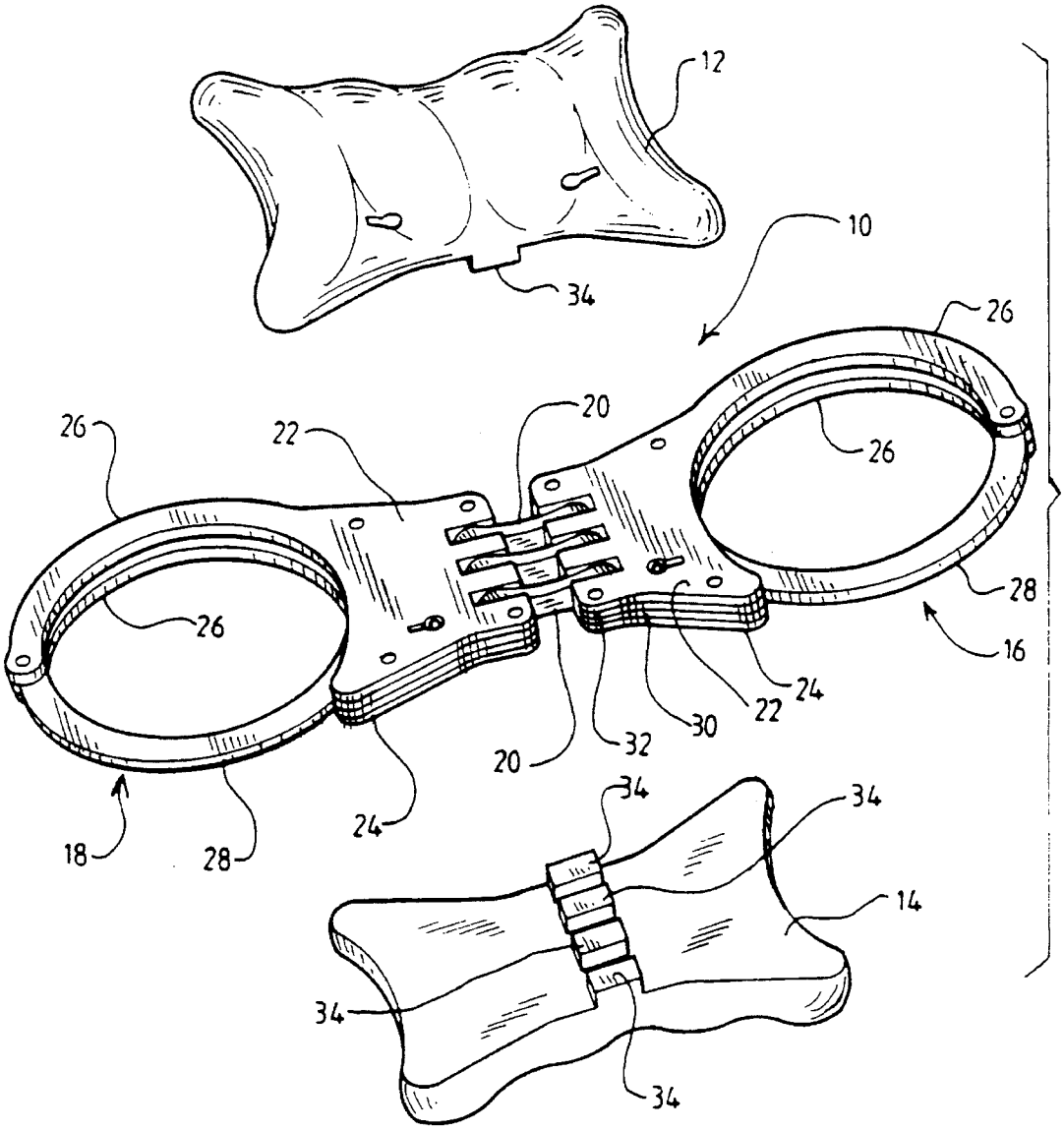
FIG. 1 is an exploded perspective view of a rigid handcuff in accordance with the invention produced by modification of a hinge type of handcuff.

Referring to FIG. 1 of the drawings there is illustrated a rigid handcuff constructed in accordance with the invention comprising a handcuff assembly 10 known per se and a pair of cover plates 12 and 14 adapted to be secured to either side of the handcuff assembly. The handcuff assembly known per se has been in use for many year and comprises two separate bracelet members 16 and 18 connected together by, in this example, three rigid hinge links 20.

Each of the bracelet members 16 and 18 is of a type known per se comprising a bracelet body having upper and lower cover plates 22, 24 each having an arcuate extension 26 to provide a pivotal mounting for a clasp member 28 having a free end (not visible in the drawings) provided with ratchet-like serrations for locking engagement with a key-operated lock mechanism (not shown) contained in each bracelet body between the cover plates 22, 24 thereof. The clasp member 28 of each bracelet member has a one-way action to cooperate with the lock mechanism in a manner well known per se. The lock mechanism is contained between the cover plates 22, 24 of each bracelet member and each said member 16 and 18 further includes intermediate spacer plates 30, 32 located between the cover plates 22, 24 and providing accommodation for the lock mechanism. As will be seen in FIG. 1, the two cover plates 22, 24 and the two spacer plates 30, 32 of each bracelet body are co-extensive with one another having slightly concave side edges. Said plates have front edges formed with through recesses to receive a hinge pin (not visible) for each of the hinge links 20. Thus the opposed front edges of the respective cover plates and spacer plates of each bracelet member each provide a castellated profile which, in this example, enables three rigid hinge links 20 to be pivotally connected between the bracelet members 16 and 18.

It will be appreciated that such a known construction of hinged type of handcuff permits relative movement between the bracelet members 16 and 18 only about the hinge pins. Thus in the extended position shown in FIG. 1 with the bracelet members 16 and 18 contained with the hinge links 20 in a common plane, the bracelet members are restrained against movement relative to one another in said common plane i.e. the bracelet members cannot move axially relative to one another along a longitudinal axis of the handcuff in said plane and neither can they pivot relative to one another about an axis normal to said plane.

Each of the cover members 12 and 14 illustrated in FIG. 1 conveniently comprises a plastic molding and is provided on an inner face thereof with a set of projections 34 configured to fit tightly between the opposed front surfaces of the respective cover plates 22, 24 and spacer plates 30, 32 of each bracelet member, and between the rigid hinge links 20. As illustrated, each of the cover members 12 and 14 is of identical configuration having a set of linearly oriented identical projections 34 whereby when the cover members are assembled to either side of the handcuff, the out ends of opposed projections will abut against one another on a plane comprising a central plane of the handcuff. The cover members may conveniently be secured to one another and to the body parts of each bracelet member by nut and, bolt assemblies with the bolts thereof passing through the handcuff from one side to the other.

Although the embodiment described herein with reference to FIG. 1 includes identical sets of locking projections 34 on identical cover plates 12 and 14, it should be appreciated that different forms of locking projections may be provided to extend between the bracelet members and the rigid hinge links. For example, it is not necessary that the locking projections are integral with cover plates; the locking projections may be provided as separate locking elements extending between the rigid hinge links and between the opposed surfaces of the bracelet members. The locking members may interlock with one another in opposed pairs thereof e.g. in a form of spigot and socket engagement, or by a snap fit interlock. Furthermore, the locking members need not interengage or abut one another on a central plane of the handcuff.

However, in all of the examples referred to above, it will be appreciated that an existing commercially available hinge type of handcuff is modified to provide a rigid handcuff by the relatively simple and economic expedient of providing locking members to extend between opposed surfaces of the bracelet members 16 and 18 and between the rigid hinge links 20. Such locking members restrain the bracelet members against pivoting about their hinges and, as mentioned above, the bracelet members are restrained against movement relative to one another in other planes by the inherent properties of the hinge type of construction. Further rigidity is imparted to the handcuff when the cover members 12 and 14 are assembled to the flat surfaces of the cover plates 22, 24 of the bracelet members whereby a wholly rigid handcuff is provided. Since, in such a construction, the bracelet members are restrained against movement relative to one another by virtue of the rigid hinge links themselves and the locking projections therebetwee, the problems associated with the proposed known modification to a chain type of handcuff are overcome.

Figure 2:
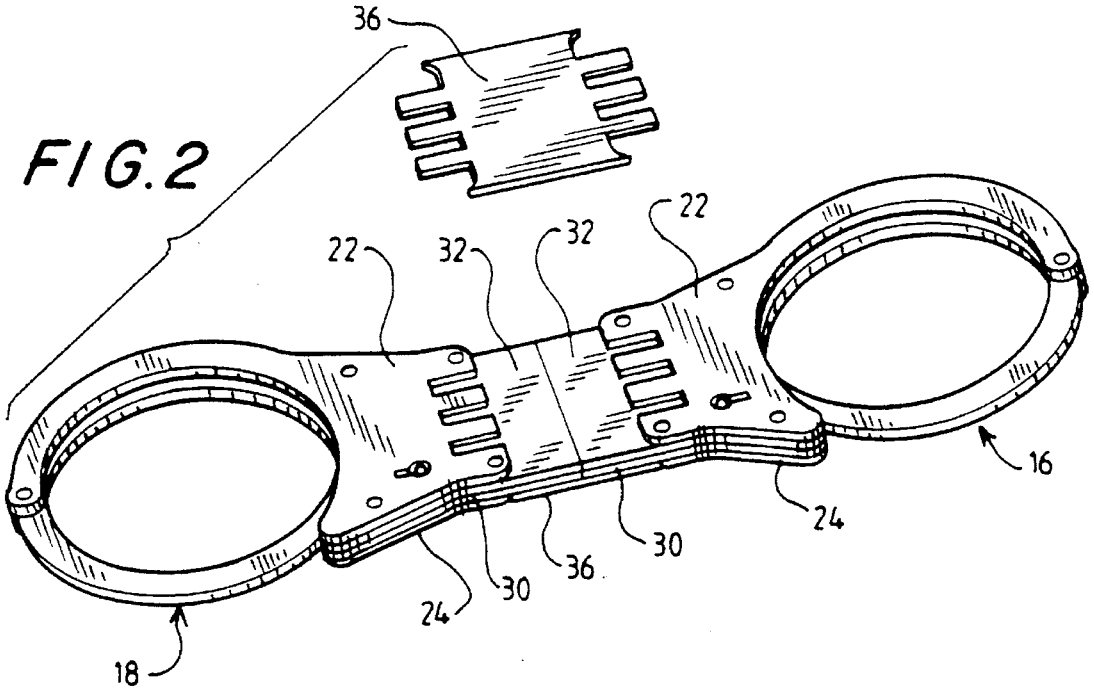
FIG. 2 is a similar view to that of FIG. 1, omitting the cover assembly, of another rigid handcuff produced by a different modification to a hinge type of handcuff.

Referring to FIG. 2 of the drawings there is shown a further embodiment of the invention wherein a hinge type of handcuff has been modified by removal of its rigid hinge links and the extension towards one another of the spacer plates 30, 32 of each bracelet member 16 and 18. The front edges of such extended spacer plates 30, 32 abut one another in a plane at the center of the handcuff and which is preferably normal to the common plane containing the bracelet members. Rigid connector means in the form of connector plates 36 are secured such as by riveting to overlie the extended spacer plates and to abut against those parts of the cover plates 22, 24 of each bracelet member which have the existing castellated profile. Thus each end of each connector plate 36 is provided with a corresponding castellated profile so that it may be received snugly between the opposed cover plates 22, 24 of the bracelet members when the opposed extended spacer plates 30, 32 are abutted against one another and the bracelet members are co-planar. Such a construction enables the production of a wholly rigid handcuff assembly by minimal conversion and adaption of an existing design of hinge type of handcuff. Such a rigid handcuff may be rendered more "user-friendly" by the addition of cover members substantially of the type illustrated in FIG. 1 but without the integral locking projections thereon i.e. each cover member would have a planar inner surface to lie against the coplanar flat outer surfaces of each respective connector plate 36 and parts of the cover plates 22 or 24 of the bracelet members.

Figure 3:
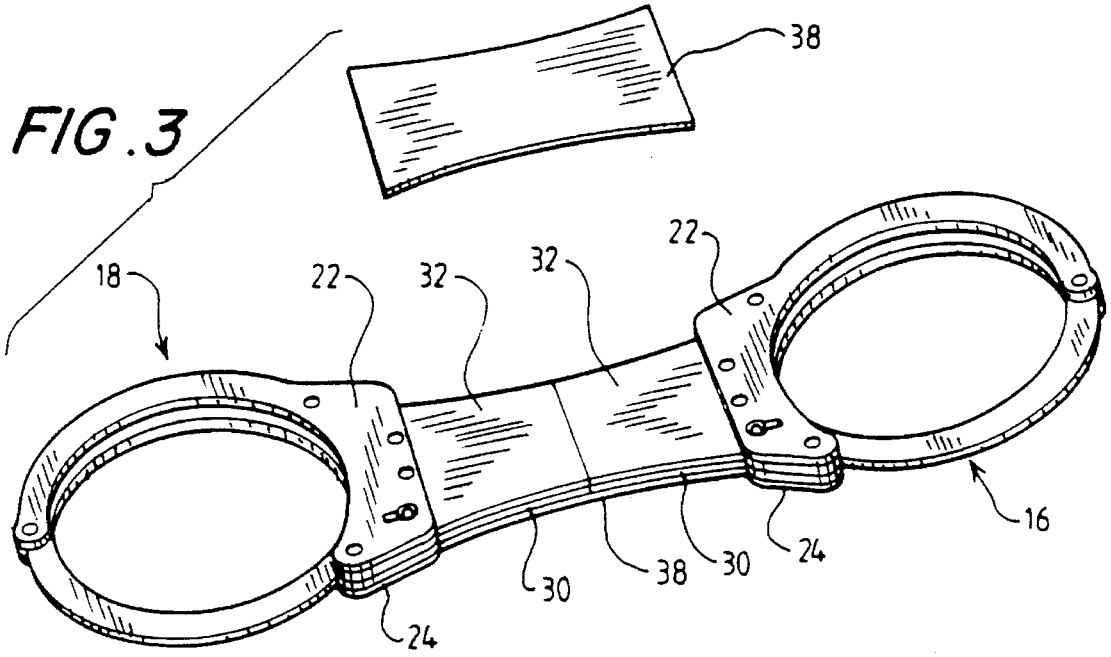
FIG. 3 is a similar view to that of FIG. 2, omitting the cover members, of a yet further rigid handcuff produced by modifying bracelet members of a type normally intended for use in a chain type of handcuff.

In FIG. 3 of the drawings there is shown a further modification of an existing design of handcuff wherein a pair of bracelet members 16 and 18 of the type generally known per se for use in a chain type of handcuff are modified by having their spacer plates 30, 32 provided with extensions so as to abut one another in a similar manner to that illustrated in FIG. 2. However, the cover plates 22, 24 of each bracelet member are not castellated whereby they may receive therebetween a connector plate 38 overlie the abutted extended spacer plates 30, 32 and to abut an uninterrupted end surface of a cover plate 22 or 24 of each bracelet member. Such a construction also enables the provision of a wholly rigid handcuff which, in similar manner to that illustrated in FIG. 2, does not permit any relative movement whatsoever between the co-planar bracelet members. In the embodiment of FIG. 3, cover members of the type described with reference to FIG. 2 may be connected to both sides of the handcuff again to render the handcuff more "user-friendly".

Thus in all of the embodiments described herein a rigid handcuff is produced by modification of a pair of initially entirely separate bracelet members known per se. Such a modification enables the production of a rigid handcuff in an extremely cost effective manner since, with reference to FIG. 1, no alteration whatsoever is made to the handcuff assembly 10 per se and, with reference to FIG. 2, it is a matter of simple tooling change to provide extensions to the spacer plates 30, 32 of the bracelet members and to provide plate-like connectors 36 having castellated ends for securement between the abutted bracelet members. Similarly, with reference to FIG. 3, a simple modification comprises an extension to the spacer plates 30, 32 of the bracelet members of a type which would otherwise be used in a chain type of handcuff together with the production of a simple plate-like connector 38 for securement between the abutted bracelet members.

We claim:

1. A rigid handcuff assembly, comprising:

a pair of separate lockable bracelet members;

rigid hinge link means pivotally connected to said lockable bracelet members and providing for movement thereof to an extended condition wherein said bracelet members and said hinge link means lie in a common plane;

said hinge link means and said bracelet members when in said extended condition affording apertures extending from one side of the handcuff assembly to the other side of the handcuff assembly;

locking members extending into apertures defined between adjacent hinge link means when the handcuff assembly is in its extended condition, whereby said locking members restrain said bracelet members against pivotal movement relative to one another from said extended condition; and a cover assembly including a pair of opposed cover members, each mountable on a respective one of said sides of the handcuff assembly to overlie at least said hinge link means.

2. The rigid handcuff assembly as claimed in claim 1, wherein said locking members are provided on said cover assembly, at least one of said cover members supporting one or more of said locking members, whereby said cover assembly provides a rigid grip for the handcuff assembly intermediate said bracelet members.

3. The rigid handcuff assembly claimed in claim 1 wherein said locking members are integral with one or more of said cover members.

4. A rigid handcuff assembly, comprising:

a pair of separate lockable bracelet members;

rigid connector means connecting said bracelet members together so that said bracelet members lie in spaced apart relationship in a common plane and are restrained against movement relative to one another in said common plane;

a cover assembly including a pair of opposed cover members, each mountable on a respective side of the handcuff assembly to overlie at least said rigid connector means;

said bracelet members having integral projecting plate-like extensions having end faces;

said plate-like extensions abutting one another at said end faces along a line normal to a longitudinal axis of the handcuff assembly, said line and said axis lying in said common plane of said bracelet members; and said rigid connector means including at least one plate-like connector sectored to said plate-like extensions to overlie said extensions, and having end surfaces each abutting against an abutment surface of a respective bracelet member, whereby said bracelet members are restrained against all movement relative to one another.

5. The rigid handcuff assembly as claimed in claim 4, wherein said abutment surface of each bracelet member comprises an uninterrupted linear or curvilinear surface for abutment by a correspondingly shaped one of said end surfaces of said at least one plate-like connector.

6. The rigid handcuff assembly as claimed in claim 4, wherein said abutment surface of each bracelet member comprises a toothed or castellated profile for abutment by a correspondingly profiled one of said end surfaces of said at least one plate-like connector.

7. The rigid handcuff assembly as claimed in claim 4, wherein each said cover member is of generally plate-like forms having an inner face in contact with the respective side of the handcuff assembly, and an outer face contoured to afford a good gripping surface for a user.

8. The rigid handcuff assembly as claimed in claim 7, wherein each said cover member is of sufficient length to overlie at least part of respective co-planar outer surfaces of said bracelet members, as well as to overlie said rigid connector means interconnecting said bracelet members.

* * * * *